US008026811B2

(12) United States Patent
Sharma et al.

(10) Patent No.: US 8,026,811 B2
(45) Date of Patent: Sep. 27, 2011

(54) SECURITY SYSTEM AND METHOD FOR USING AN LF ACTIVATED RFID TAG

(75) Inventors: Raman Kumar Sharma, Toronto (CA); Francisco Bogarin, Toronto (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 421 days.

(21) Appl. No.: 12/166,884

(22) Filed: Jul. 2, 2008

(65) Prior Publication Data

US 2010/0001859 A1 Jan. 7, 2010

(51) Int. Cl.
*G08B 13/00* (2006.01)

(52) U.S. Cl. ..... 340/545.1; 340/5.2; 235/375

(58) Field of Classification Search .... 340/545.1–545.7, 340/5.7, 5.71, 5.2, 572.1–572.9; 235/375–385
See application file for complete search history.

(56) References Cited

U.S. PATENT DOCUMENTS

| | | | | |
|---|---|---|---|---|
| 7,388,466 | B2 * | 6/2008 | Ghabra et al. | 340/5.61 |
| 2005/0046564 | A1 | 3/2005 | Eskildsen et al. | |
| 2005/0264411 | A1 * | 12/2005 | Katz | 340/506 |
| 2007/0132584 | A1 | 6/2007 | Malacame et al. | |
| 2008/0055040 | A1 * | 3/2008 | Lizza et al. | 340/5.7 |
| 2008/0068162 | A1 | 3/2008 | Sharma et al. | |
| 2008/0100446 | A1 | 5/2008 | Shintani | |
| 2008/0100448 | A1 * | 5/2008 | Sharma | 340/572.3 |

FOREIGN PATENT DOCUMENTS

| | | | |
|---|---|---|---|
| WO | WO 03/079192 | A1 | 9/2003 |
| WO | WO 2004/012163 | A2 | 2/2004 |

* cited by examiner

*Primary Examiner* — George Bugg
*Assistant Examiner* — Edny Labbees
(74) *Attorney, Agent, or Firm* — The Small Patent Law Group, LLP

(57) ABSTRACT

A security system includes a system control panel for arming and disarming a security system. A door sensing unit is mounted proximate to a door to be monitored. The door sensing unit includes a door contact, a radio frequency (RF) transceiver, and a low frequency (LF) transmitter. The door contact is configured to detect open and closed states of the door. The RF transceiver is interconnected with the system control panel over a network and the LF transmitter transmits an LF data packet when the door contact detects the open state of the door. A disarm device having an LF detection circuit detects the LF data packet. The disarm device transmits an RF disarm data packet based on the LF data packet. The RF transceiver transmits a disarm message to the system control panel over the network to disarm the security system based on the RF disarm data packet.

18 Claims, 5 Drawing Sheets

SECURITY SYSTEM AND METHOD FOR USING AN LF ACTIVATED RFID TAG

BACKGROUND OF THE INVENTION

This invention relates generally to security systems, and more particularly, to automatically disarming a security system.

Security systems are installed in homes and businesses to protect the premises within a perimeter. Unfortunately, a large number of false alarms are generated due to human error. The home or business owner is typically responsible for costs incurred by police or other security personnel who are sent to respond to a false alarm. Also, a great number of false alarms may result in slower response times during a true event or emergency due to less available security personnel or a perceived lack of urgency.

When the security system is armed, the person entering the home or business has to disable the alarm by, for example, entering a code into a panel or input device such as a keypad, or finding and holding a radio frequency identification (RFID) tag up to an RFID reader within a set amount of time. If the person is not aware that the system is armed or is unable to disarm the system within the set time, an alarm is generated. Also, authorized workers or other people may be given access to the home or business, but may forget the code or enter a code for a different location which will trigger an alarm. Setting the system to disarm based on simply unlocking a door also causes security risks, as locks can be picked or potentially unlocked by breaking a window or door panel, then unlocking the door from the inside.

Some systems have used active RFID tags that continuously transmit a code at certain intervals, such as every five seconds. The RFID tag is powered by one or more batteries and may not need to be held close to a detection device of the system for the code to be received. However, the continuous transmission requires so much energy that the life of the battery powered tag is limited. Also, if the RFID tag does come in close enough proximity to a keypad or reader, such as from inside the perimeter of the premises; the alarm system may be turned off accidentally.

Therefore, a need exists for disarming the security system without human intervention while extending the life span of the disarming tag. Certain embodiments of the present invention are intended to meet these needs and other objectives that will become apparent from the, description and drawings set forth below.

BRIEF DESCRIPTION OF THE INVENTION

In one embodiment, a security system comprises a system control panel for arming and disarming a security system. A door sensing unit is mounted proximate to a door to be monitored. The door sensing unit comprises a door contact, a radio frequency (RF) transceiver, and a low frequency (LF) transmitter. The door contact is configured to detect open and closed states of the door. The RF transceiver is interconnected with the system control panel over a network and the LF transmitter is configured to transmit an LF data packet when the door contact detects the open state of the door. A disarm device comprising an LF detection circuit is configured to detect the LF data packet. The disarm device is configured to transmit an RF disarm data packet based on the LF data packet. The RF transceiver is configured to transmit a disarm message to the system control panel over the network to disarm the security system based on the RF disarm data packet.

In another embodiment, a method for automatically disarming a security system comprises detecting an open state of a door to be monitored. An LF data packet is transmitted with, a door sensing unit mounted; proximate to the door. The door sensing unit is interconnected with the security system. The LF data packet comprises at least one of a Door ID associated with the door and a System ID associated with the system. The LF data packet is received with a disarm device. A disarm data packet is transmitted with the disarm device. The disarm data packet comprises at least one identifier associated with the disarm device. The security system is disarmed when the at least one identifier is associated with an approved disarm device.

In yet another embodiment, a security system comprises means for detecting open and closed states of a door being monitored by the security system. An LF transmitter is configured to transmit an LF data packet when the door is detected in the open state. A disarm device is configured to detect the LF data packet. The disarm device is further configured to transmit an RF disarm data packet when the LF data packet comprises a first approved ID. The system further comprises means for automatically disarming the security system when the RF disarm data packet comprises a second approved ID.

DETAILED DESCRIPTION OF THE INVENTION

Figure 1:
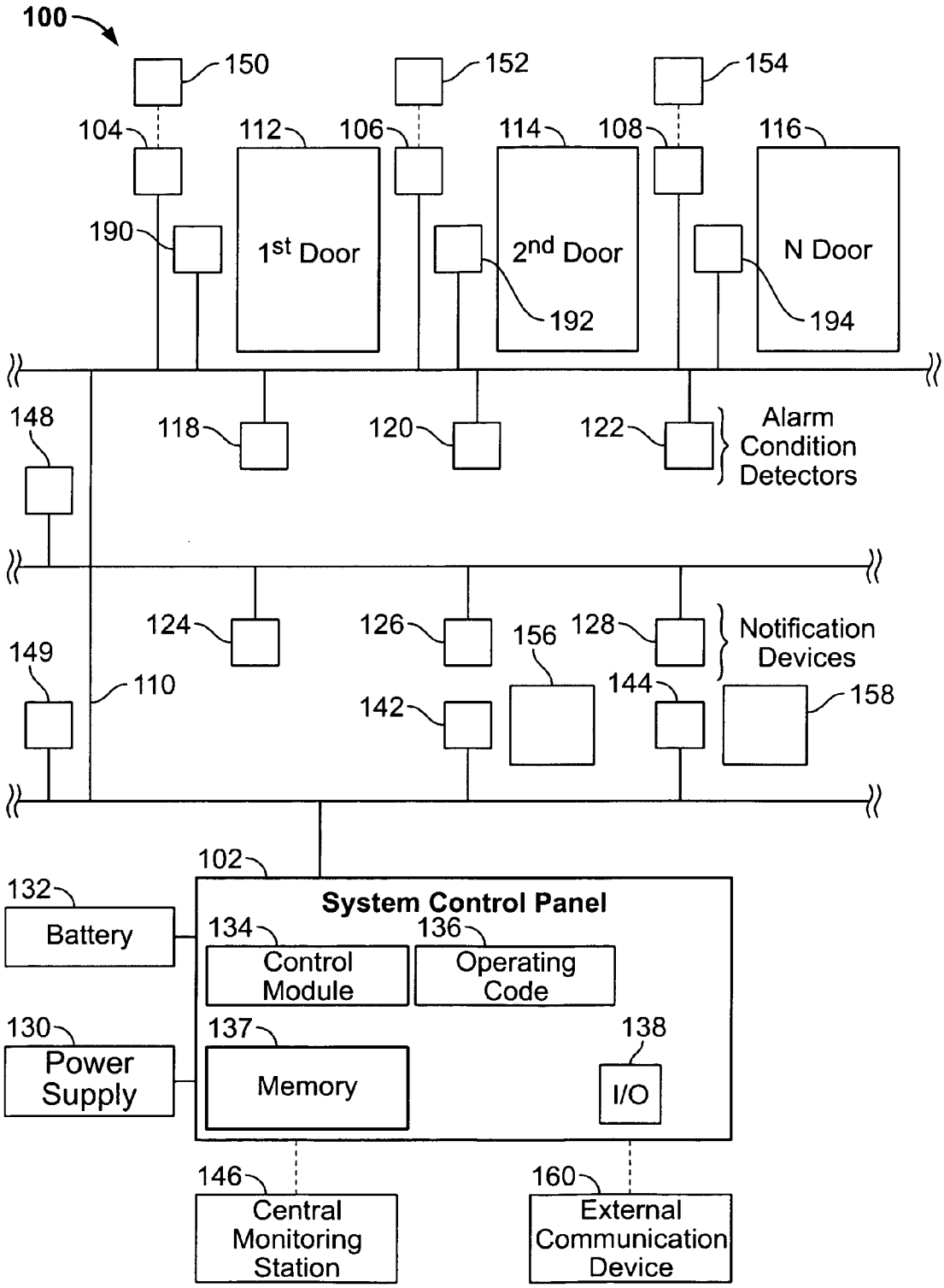
FIG. 1 illustrates a security system that has a system control panel for monitoring and/or controlling devices installed on a network in accordance with an embodiment of the present invention.

The foregoing summary, as well as the following detailed description of certain embodiments of the present invention, will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or random access memory, hard disk, or the like). Similarly, the programs may be stand alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited, features. Moreover, unless explicitly stated to the contrary, embodiments "comprising" or "having" an element or a plurality of elements having, a particular property may include additional such elements not having that property.

FIG. 1 illustrates a security system 100 that has a system control panel 102 for monitoring and/or controlling devices installed on a network 110. The network 110 may provide communication over both wired and wireless connections. The devices may detect and/or control door openings and closings, detect motion, detect alarm conditions, notify people within an area about alarm conditions, or accomplish other functions which may be desired. For example, the system 100 may be used within a light industrial building or a residence.

The system 100 has one or more door sensing units, such as first door sensing unit 104, second door sensing unit 106 through N door sensing, unit 108 which may be configured to monitor first door 112, second door 114, through N door 116, respectively. Each of the first through N door sensing units 104-108 may receive signals from and send signals to, any of first, second through N disarm devices 150, 152 and 154. When the system 100 is in an Armed Mode and the door 112-116 is opened, the respective door sensing unit 104-108 transmits a low frequency (LF) signal to wake up any disarm device 150-154 in the, immediate area of the door. By way of example only, the signals may be electrical signals, packets, and thee like. For example, the LF signal may be within a range of 100 KHz to 140 KHz, but may be lower, such as 60 KHz, and thus is not limited to a particular low frequency or range of low frequencies.

The first through N door sensing units 104-108 communicate with the system control panel 102 over the network 110. Each of the door sensing units 104-108 has a unique address on the network 110. Optionally, first, second through N input devices 190, 192 through 194 (such as a keypad or other input capability) may be mounted proximate to the first, second through N doors 112, 114 and 116, respectively, or in other convenient locations to allow a user to manually change a system mode, enter data such as a security code, and manually arm and disarm the system 100.

First through N window sensors 142 and 144 may monitor first through N windows 156 and 158 for unauthorized opening or glass breaking. Also, one or more motion sensors 148 and 149 may be used to detect motion within the monitored area. Alarm condition detectors 118, 120 and 122 may be connected on the network 110 and are monitored by the system control panel 102. The detectors 118-122 may detect fire, smoke, temperature, chemical compositions, or other hazardous conditions. When an alarm condition is sensed, the system control panel 102 transmits an alarm signal to one or more of the addressable notification devices 124, 126 and/or 128 through the network 110. The addressable notification devices 124, 126 and 128 may be horns and/or strobes, for example.

The network 110 is configured to carry power and communications to the addressable notification devices 124-128 from the system control panel 102. Each addressable notification device 124-128 has a unique address and may be capable of communication with the system control panel 102. The addressable notification devices 124-128 may communicate their status and functional capability to the system control panel 102 over the network 110.

The system control panel 102 is connected to a power supply 130 that provides one or more levels of power to the system 100. One or more batteries 132 may provide a back-up power source for a predetermined period of time in the event of a failure of the power supply 130 or other incoming power. Other functions of the system control panel 102 may include displaying the status of the system 100, resetting a component, a portion, or all of the system 100, silencing signals, turning off strobe lights, and the like.

The system control panel 102 has a control module 134 that provides control software and hardware to operate the system 100. Operating code 136 may be provided on a hard disk, ROM, flash memory, stored and run on a CPU card, or other memory. An input/output (I/O) port 138 provides a communication interface at the system control panel 102 with an external communication device 160 such as a laptop computer. A memory 137 may store system configuration information, a System Identifier associated with the system 100, identifiers associated with one or more disarm devices 150-154, identifiers associated with doors 112-116, information for establishing connection to a central monitoring station 146, and the like.

The central monitoring station 146 may receive communications from the system control panel 102 regarding security problems and alarm conditions. The central monitoring station 146 is typically located remote from the system 100 and provides monitoring to many security systems.

During normal operation, the security system 100 may be set in several modes, such as Armed Mode and Disarmed Mode. Other modes of operation may be used. The modes of the system 100 may he changed by entering a code at the system control panel 102, at one of the input devices 190-194 located proximate to a door or other desirable location, or with the disarm devices 150-154. Armed Mode may arm all of the security features, such as the first through N door sensing units 104-108, first through N window sensors 142 and 144, as well as the motion sensors 148 and 149. Other armed modes may arm a subset of the security features. The Disarmed Mode may disarm the door, window and motion detectors, but may not disarm the alarm condition detectors 118-122, which may be armed in all modes.

It should be understood that the system 100 may allow a user to choose which devices interconnected on the network 110 are armed and which are not armed in each mode, as well as to define additional modes. For example, zones may be established such that a first set of monitoring devices are armed while a second set is not armed. This may be desirable when the security system 100 is shared between more than one business, or when it is desired to monitor only a portion of the entire area. For example, a home owner may wish to arm all doors and windows except those along the back side of the home, allowing the occupants to move between the backyard and the interior freely without setting of the alarm.

Figure 2:
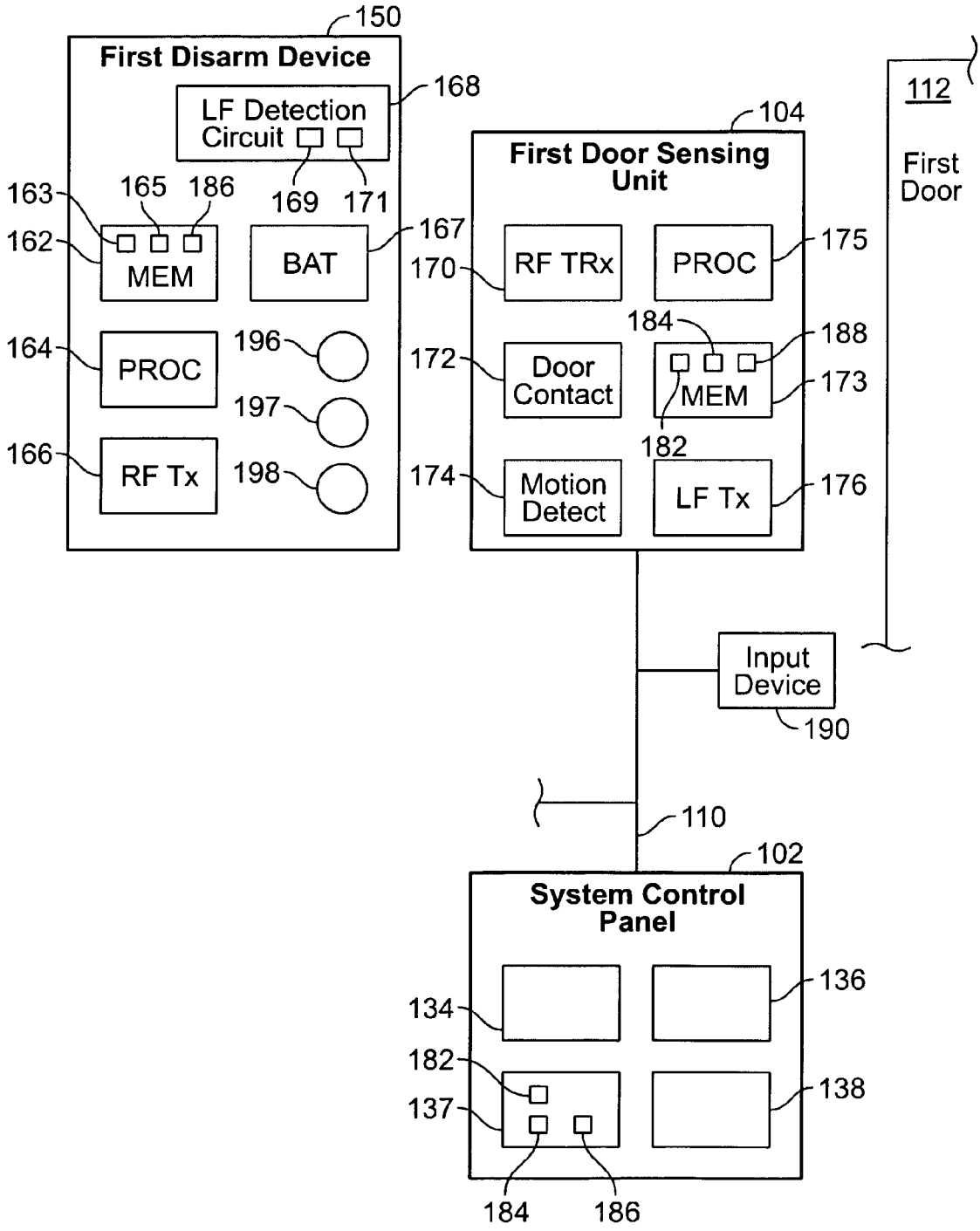
FIG. 2 illustrates a block diagram of a disarm device and a door sensing unit that is mounted proximate to a door formed in accordance with an embodiment of the present invention.

FIG. 2 illustrates a block diagram of the first disarm device 150 and the first door sensing unit 104 that is mounted proximate to the first door 112. It should be understood that the second through N door sensing units 106 and 108 have similar functionality and configuration as the, first door sensing unit 104 and that the second through N disarm devices 152 and 154 have similar functionality and configuration as the first disarm device 150, and thus will not be discussed in detail.

Each of the first through N disarm devices 150-154 are small in size and easily portable. For example, a user may keep one of the disarm devices 150-154 in a pocket, briefcase, purse, backpack and the like. The first disarm device 150 has a memory 162 for storing knowledge about the system 100 and the first disarm device 150, a microprocessor 164, a radio frequency (RF) transmitter 166, a battery 167, and an LF detection circuit 168. In some embodiments, the RF transmitter 166 may be replaced with an RF transceiver that is also configured to receive RF signals and/or packets.

The LF detection circuit 168 may have an antenna coil 169 that detects an LF transmission such as a burst, packet, signal and the like, and an LF processing circuit 171 that determines if the LF transmission meets certain predetermined parameters. For example, the LF processing circuit 171 may determine if the LF transmission is at a predetermined frequency or within a range of predetermined frequencies, such as by filtering. Also, the LF processing circuit 171 may determine if the LF transmission has at least a minimum power level. The battery 167 supplies a low level of power to the LF detection circuit 168 so that the LF detection circuit 168 is able to constantly detect low frequency transmissions without further stimulus.

A unique Device Identifier (ID) 163, such as an identification code, token, or other security code is stored in the memory 162 of the first disarm device 150 and is used by the system 100 to authenticate the first disarm device 150. Each disarm device 150-154 is preauthorized and may have its own unique Device ID 163. A System ID 165 corresponding to a System ID associated with the system 100 is also stored in the memory 162. Also stored in memory is a List of Approved Door IDs 186 having at least one Door ID thereon. For example, each entry/exit point in the system 100, such as each door, may have a unique Door ID. The information stored in the memory 162 is used by the first disarm device 150 to form RF data packets, herein referred to as RF disarm device packets. It should be understood that although RF data packets are discussed, other forms of wireless communication may be used, such as LF data packets, to transmit the data in the memory 162.

The first door sensing unit 104 has an RF transceiver 170, a door contact 172, a memory 173, an optional motion detector 174, a microprocessor 175, and an LF transmitter 176. In one embodiment, the LF transmitter 176 may be any transmitter that is capable of transmitting LF signals and/or LF data packets. In another embodiment, the transmitting functions of the LF transmitter 176 and the RF transceiver 170 may be accomplished by a single transmitter or transceiver (not shown) that is configured to transmit both LF and RF. The door contact 172 may be wireless and may be used to detect whether the first door 112 is open or closed. The door contact 172 is not limited to any particular type of contact, and thus any door contact that detects the opening of the door 112 may be used. When the door contact 172 detects that the first door 112 is opened, the door contact 172 activates the LF transmitter 176 and the LF transmitter 176 transmits at least one pulse or burst of LF energy at a predetermined frequency and power level. The motion detector 174 may be a passive infrared (IR) detector or other type of motion detector and may sense motion proximate to the first door 112. It should be understood that the components shown within the first door sensing unit 104 may be housed within one unit or multiple units, and that some functions of the first door sensing unit 104, such as the RF transceiver 170 and/or the LF transmitter 176, may alternatively be housed within the input device 190.

A List of Approved Device IDs 182 including at least one Device ID, a System ID 184 associated with the security system 100, and a Door ID 188 associated with the first door 112, may be stored in the memory 173 of the first door sensing unit 104. Alternatively, a single ID may be used rather than assigning a unique Door ID and the System ID.

Each of the disarm devices 150-154 may be provided with buttons available to the user for manually setting the mode of the system 100. For example, pressing Arm button 196 may cause the RF transmitter 166 to transmit an Arm Command Device Data Packet to set the system 100 to an Armed Mode, Disarm button 197 may cause a Disarm Command Device Data Packet to be transmit to set the system 100 to a Disarmed Mode, and Status button 198 may cause a Request Status Device Data Packet to be transmit to request an acknowledge packet that will indicate to the user what mode the system 100 is in. For example, one or more LEDs (not shown) may be set to flash to indicate Armed and Disarmed modes. Optionally, the first door sensing unit 104 may be provided with the ability to produce a sound or chirp to indicate mode. Optionally, the input device 190 nay have a display and/or lights to indicate the mode of the system 100.

Figure 3:
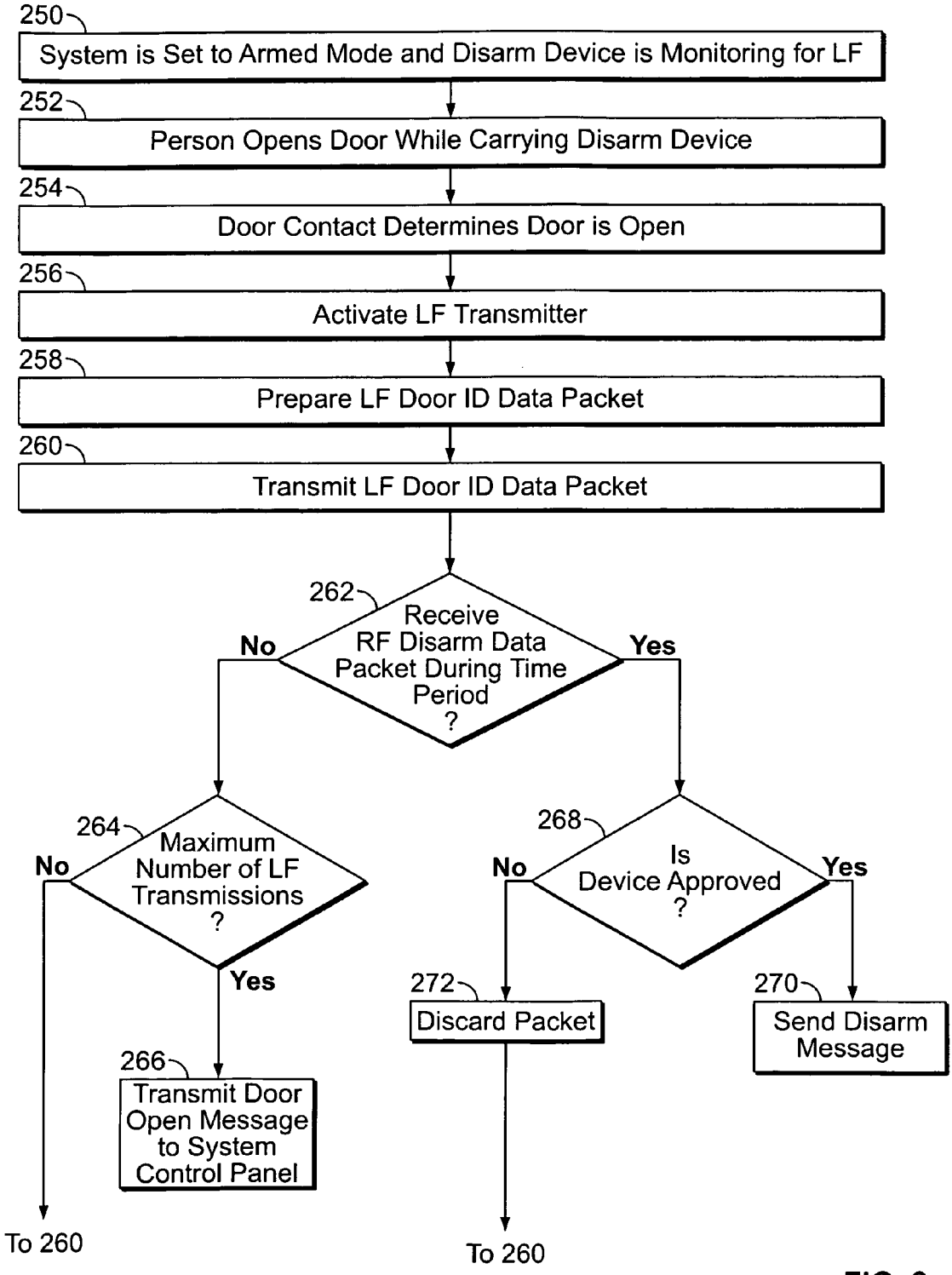
FIG. 3 illustrates a method for disarming the security system using a disarm device in accordance with an embodiment of the present invention.
Figure 4:
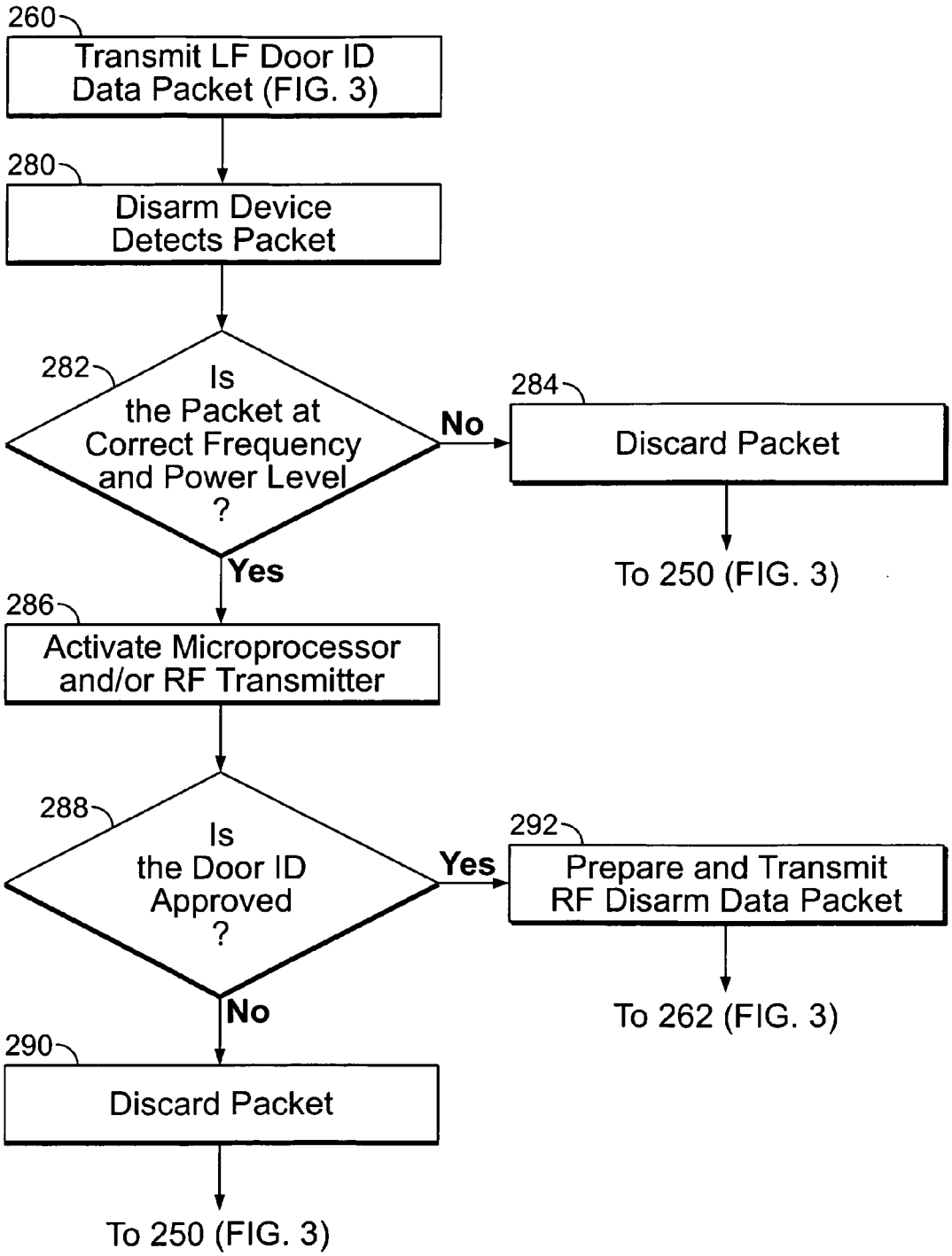
FIG. 4 illustrates a method for activating a disarm device using LF energy that is transmitted by a door sensing unit in accordance with an embodiment of the present invention.

FIG. 3 illustrates a method for disarming the security system 100 using one of the disarm devices 150-154 and FIG. 4 illustrates a method for activating a disarm device 150-154 using LF energy that is transmitted by a door sensing unit 104-108. Although the first disarm device 150 is used to disarm the first door 112 in the following discussion, it should be understood that any of the first through N disarm devices 150-154 having a valid Device ID 163 and entering through an approved entry/exit point or door may be used to disarm the security system 100.

Figure 5:
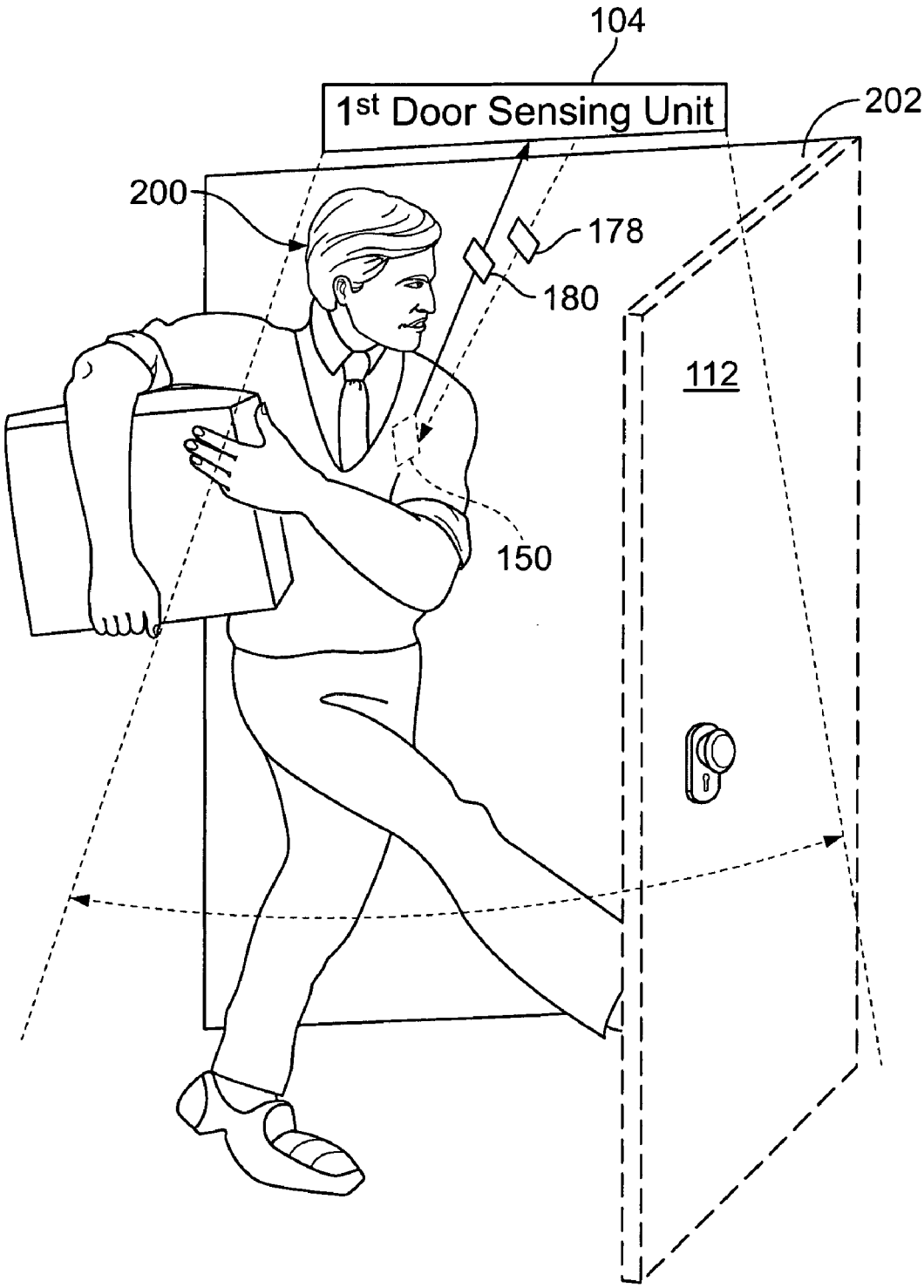
FIG. 5 illustrates a person using a disarm device to disarm a door in accordance with an embodiment of the present invention.

FIG. 5 illustrates a person 200 using the first disarm device 150 to disarm the first door 112. The first door sensing unit 104 is installed proximate to the first door 112, such as above the first door 112 as shown, within the door frame, or proximate the door frame. An LF transmission field 202 in which the LF detection circuit 168 (FIG. 2) of the first disarm device 150 can detect LF data packets sent by the first door sensing unit 104 is formed in the immediate doorway of the first door 112. Anyone moving through the doorway of the first door 112 will move through the LF transmission field 202. The size of the LF transmission field 202 may be determined by a power level used to transmit the LF data packets. Therefore, a higher power level may be used to expand the LF transmission field 202 to include more area proximate to the doorway of the first door 112. FIGS. 3-5 will be discussed together.

Turning to FIG. 3, at 250 the system 100 is set to Armed Mode, such as by selecting the feature or entering a predetermined code at the system control panel 102 or one of the input devices 190-194, or by using the Arm button 196 on the first disarm device 150. As discussed previously, all of the security features, such as the first through N door sensing units 104-108, first through N window sensors 142 and 144, and the motion sensors 148 and 149 may be armed in the Armed Mode.

At 252, the person 200 unlocks, if necessary, and opens the first door 112. The person 200 may be the owner of the home, a member of the business, or a contractor, for example. As illustrated in FIG. 5, the person 200 may have the first disarm device 150 in a pocket, although the first disarm device 150 may also be carried in a wallet, bag, purse, or other item, except that the first disarm device 150 may not work reliability if placed within a metal container or other container that may block the LF and/or RF transmissions. There is no need for the person 200 to locate the first disarm device 150 and/or position it at a particular position with respect to the first door sensing unit 104 or input device 190.

At 254, the door contact 172 within the first door sensing unit 104 detects a Door Open state and determines that the first door 112 is open, and at 256, the LF transmitter 176 in the first door sensing unit 104 is activated. For example, the door contact 172 may signal the microprocessor 175 when the first door 112 is opened, and the microprocessor 175 may wake up or activate the LF transmitter 176. Other activation schemes may be used to activate the microprocessor 175 and the LF transmitter 176 after the Door Open state is detected.

At 258, the microprocessor 175 prepares an LF data packet, herein referred to as LF Door ID Data Packet 178, that comprises the Door ID 188. In one embodiment the LF Door ID Data Packet 178 may also include the System ID 184. Therefore, each of the disarm devices 150-154 may be restricted to using particular doors within a premises and may not be authorized to disarm all of the doors. Alternatively, the microprocessor 175 may prepare an LF data packet comprising the System ID 184 without the Door ID 188.

At 260, the LF transmitter 176 transmits the LF Door ID Data Packet 178. The LF Door ID Data Packet 178 has a predetermined frequency, such as 125 KHz, and is transmitted at a predetermined power level. It should be understood that 125 KHz is an exemplary frequency and that other frequencies may be used. Also, the power level may be low such that the LF Door ID Data Packet 178 is only detected within a predetermined area or range, such as the LF transmission field 202, that may include most or all of the doorway from the top of the frame of the door to near or at the floor, and may extend to approximately three to five inches on either side of the frame of the first door 112. Therefore, the LF Door ID Data Packet 178 may not be detected and/or responded to by disarm devices that are outside of the desired area of the first door 112. The detection of the LF Door ID Data Packet 178 by the disarm device 150-154 and the response of the disarm device 150-154 thereto is discussed farther below in FIG. 4.

At 262, the RF transceiver 170 of the first door sensing unit determines if an RF disarm data packet has been received from a disarm device 150-154 within a predetermined time period. The time period may be, for example, 30 ms or 1 second, but is not limited, to any specific time duration. If no response is detected during the time period, at 264 the microprocessor 175 may determine how many times an LF Door ID Data Packet 178 has been transmitted since the first door 112 was opened. For example, the LF transmitter 176 may transmit six consecutive LF Door ID Data Packets 178, each separated by the time period. Other maximum numbers of transmissions may be used, as well as other time periods. If the maximum number of LF transmissions has not been met, the method returns to 260 to transmit the next LF Door ID Data Packet 178. If the maximum number of transmissions has been met, at 266 the microprocessor 175 prepares and the RF transceiver 170 transmits a door open message to the system control panel 102. The system control panel 102 may then wait a predetermined time, allowing the person 200 to enter a disarm code manually into the input device 190. If a disarm code is not entered, the system control panel 102 may generate an alarm by contacting the central monitoring station 146, cause a local alarm to ring at the premises, and the like.

Returning to 262, if the RF transceiver 170 receives an RF disarm data packet, at 268 the microprocessor 175 determines whether the Device ID 163 indicated in the RF disarm data packet is on the List of Approved Device IDs 182. If yes, the first disarm device 150 is an approved device, and at 270 the microprocessor 175 prepares and the RF transceiver 170 transmits a disarm message to the system control panel 102. In one embodiment, the first door sensing unit 104 may transmit an acknowledge message to the first disarm device 150 in either an LF data packet or, if the first disarm device 150 is configured to receive RF transmissions, an RF data packet.

The system 100 is thus automatically disarmed without requiring input from the person 200. The person 200 may use a key to open the first door 112 while carrying the first disarm device 150, and does not need to remember an access code to enter into the first input device 190 or present a disarm device to prevent a false alarm from being generated.

Returning to 268, if the Device ID 163 is not on the List of Approved Device IDs 182, at 272 the microprocessor 175 may discard the RF disarm data packet and return to 260. For example, the RF packet may he from a disarm device 150-154 that is not approved to enter the first door 112 or may be for a different security system. Also, the first disarm device 150 may have been previously approved, such as to allow a contractor or employee access, then the access may have been terminated when the work was finished or the employee is no longer employed in the facility. A Device ID may also be removed from the list of approved Device IDs 182 if the first disarm device 150 is stolen or lost.

Turning to FIG. 4, at 280 the LF detection circuit 168 within the first disarm device 150 detects the LF Door ID Data Packet 178 if the first disarm device 150 is close enough to the first door 112 when the LF transmitter 176 transmits the LF Door ID Data Packet 178 at 260. As discussed previously, the first disarm device 150 needs to be within a predetermined area (i.e. the LF transmission field 202) of the first door 112. For example, if a second person (not shown) unlocks the first door 112 while the person 200 in possession of the first disarm device 150 stands away from the first door 112, the system 100 may not be disarmed unless the person 200 moves through the first door 112, such as within or through the LF transmission field 202 as previously discussed, within the predetermined length of time (262 and 264 of FIG. 3).

At 282, the LF detection circuit 168 determines whether the LF Door ID Data Packet 178 was transmitted at the predetermined frequency and has a minimum power level. For example, the first disarm device 150 may be configured to respond to LF door ID data packets transmitted at 125 KHz. Any detected packets that were transmitted at frequencies other than 125 KHz may be discarded. The first disarm device 150 may also be configured to respond to LF door ID data packets that are transmitted within a predetermined range of frequencies, such as 120 KHz to 130 KHz. Packets that are detected below a predetermined power level are also discarded. Therefore, battery power is conserved as the first disarm device 150 may not activate the microprocessor 164 and/or RF transmitter 166 to respond to LF data packets that may be for different systems or LF data packets that are sent from locations too far away from the first disarm device 150, preventing the first disarm device 150 from disarming the system 100 by accident.

If the frequency and/or power level do not meet the predetermined parameters, the LF detection circuit 168 discards the LF Door ID Data Packet 178 at 284 and returns to monitoring for LF activity. If the frequency and power level are within the predetermined parameters, at 286 the LF detection circuit 168 activates the microprocessor 164 and/or RF transmitter 166. For example, the LF detection circuit 168 may send an interrupt to the microprocessor 164 and optionally to the RF transmitter 166.

At 288, the microprocessor 164 determines whether the Door ID 188 in the LF Door ID Data Packet 178 is on the List of Approved Door IDs 186 that the first disarm device 150 is allowed to disarm. The microprocessor 164 may also confirm other parameters if included within the LF Door ID Data Packet 178, such as the system ID 184. If no, at 290 the microprocessor 164 discards the LF Door ID Data Packet 178 and does not generate a response. The method returns to 250 where the LF detection circuit 168 within the first disarm device 150 continues to monitor for LF activity. Any circuitry within the first disarm device 150 that was activated to respond to the LF Door ID Data Packet 178, such as the microprocessor 164 and RF transmitter 166, may be returned to a dormant mode, such as after a time period, to conserve energy.

If the Door ID 188 in the LF Door ID Data Packet 178 is on the List of Approved Door IDs 186, the method passes from 288 to 292 where the microprocessor 164 prepares an RF disarm data packet 180 that is transmitted by the RF transmitter 166. The RF disarm data packet 180 comprises the Device ID 163 of the first disarm device 150 and may also comprise the System ID 165. The method then passes to 262 (FIG. 3) where the RF disarm data packet 180 is detected by the RF transceiver 170 within the first door sensing unit 104. In another embodiment, the microprocessor 164 may prepare an LF disarm data packet (not shown) that is transmitted by an LF transmitter (not shown) and detected by an LF transceiver in the first door sensing unit 104.

After sending the RF disarm data packet 180, the LF detection circuit 168 in the first disarm device 150 is powered at a low level to be able to detect LF stimulus and the microprocessor 164 and RF transmitter 166 are dormant, or not supplied with power, to conserve power in the battery 167. There is no need to turn the first disarm device 150 on or off. Optionally, the first disarm device 150 may wait for a predetermined period of time after sending the RF disarm data packet 180 before returning to the dormant mode.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein" Moreover, in the following claims, the terms "first," "second," and "third," etc. are used merely as labels, and are not intended to impose numerical requirements on their objects. Further, the limitations of the following claims are not written in means plus function format and are not intended to be interpreted based on 35 U.S.C.§112, sixth paragraph, unless and until such claim limitations expressly use the phrase "means for" followed by a statement of function void of further structure.

What is claimed is:

1. A security system comprising:

a system control panel for arming and disarming a security system;

a door sensing unit mounted proximate to a door to be monitored, the door sensing unit comprising:

a door contact configured to detect open and closed states of the door;

a radio frequency (RF) transceiver interconnected with the system control panel over a network; and a low frequency (LF) transmitter configured to transmit an LF data packet when the door contact detects the open state of the door; and a disarm device comprising an LF detection circuit configured to detect the LF data packet, the disarm device configured to discard the LF data packet when a frequency of the LF data packet is outside a predetermined range of frequencies to conserve power in the disarm device and activate an RF transmitter within the disarm device to transmit an RF disarm data packet based on the LF data packet when the frequency of the LF data packet is within the predetermined range of frequencies, the RF transceiver configured to transmit a disarm message to the system control panel over the network to disarm the security system based on the RF disarm data packet.

2. The security system of claim 1, wherein the disarm device further comprises an RF transmitter configured to transmit the RF disarm data packet, the LF detection circuit further configured to activate the RF transmitter when the LF detection circuit detects the LF data packet.

3. The security system of claim 1, wherein the LF detection circuit is further configured to determine if the LF data packet has at least a minimum power level, discard the LF data packet when the LF data packet is below the minimum power level, and activate the RF transmitter within the disarm device to transmit an RF disarm data packet when the LF data packet is above the minimum power level.

4. The security system of claim 1, further comprising:

the door sensing unit further comprising a memory storing a Door Identifier (ID) associated with the door, the LF data packet comprising the Door ID; and the disarm device further comprising a memory storing at least one Door ID associated with at least one door, the disarm device transmitting the RF disarm data packet when the Door ID of the LF data packet is the same as the at least one Door ID.

5. The security system of claim 1, further comprising:

the disarm device further configured to store a Device ID associated with the disarm device, the RF disarm data packet further comprising the Device ID; and the door sensing unit further configured to store at least one approved Device ID associated with at least one approved disarm device, the RF transceiver further configured to transmit the disarm message when the Device ID of the RF disarm data packet is the same as the at least one approved Device ID.

6. The security system of claim 1, wherein the LF transmitter is further configured to transmit a plurality of LF data packets, each of the LF data packets being separated by a predetermined time period.

7. The security system of claim 1, wherein the disarm device further comprises an RF transmitter and a battery configured to provide a low level of power to the LF detection circuit, wherein the battery is further configured to provide power to the RF transmitter after the LF detection circuit detects the LF data packet and remove power from the RF transmitter after the RF transmitter transmits the RF disarm data packet.

8. A method for automatically disarming a security system comprising:

detecting an open state of a door to be monitored;

transmitting a low frequency (LF) data packet with a door sensing unit mounted proximate to the door, the door sensing unit interconnected with the security system, the LF data packet comprising at least one of a Door ID associated with the door and a System ID associated with the system;

receiving the LF data packet with a disarm device;

discarding the LF data packet when the LF data packet has a frequency that is different than a predetermined frequency or outside of a range of predetermined frequencies, to conserve power in the disarm device, transmitting a disarm data packet with the disarm device when the LF data packet is within the predetermined range of frequencies, the disarm data packet comprising at least one identifier associated with the disarm device; and disarming the security system when the at least one identifier is associated with an approved disarm device.

9. The method of claim 8, the transmitting further comprising transmitting the LF data packet at a frequency within a range of 100 KHz to 140 KHz.

10. The method of claim 8, further comprising activating an RF transmitter in the disarm device when the disarm device receives the LF data packet, the disarm data packet being transmitted by the RF transmitter.

11. The method of claim 8, further comprising:

storing at least one second identifier associated with at least one of the door and the system in the disarm device; and discarding the LF data packet when the at least one of the door ID and the system ID is different than the at least one second identifier stored in the disarm device.

12. The method of claim 8, further comprising:

storing at least one approved identifier associated with the approved disarm devices in the system; and discarding the disarm data packet when the at least one identifier associated with the disarm device is different than the at least one approved identifier associated with the approved disarm devices.

13. The method of claim 8, wherein the disarming further comprises transmitting a disarm message from the door sensing unit to a system control panel.

14. The method of claim 8, further comprising:

comparing a power level associated with the LF data packet received with the disarm device to a minimum power level; and discarding the LF data packet when the power level is less than the minimum power level.

15. A security system, comprising:

means for detecting open and closed states of a door being monitored by the security system;

a low frequency (LF) transmitter configured to transmit an LF data packet when the door is detected in the open state;

a disarm device configured to detect the LF data packet, the disarm device further configured to discard the LF data packet when a frequency of the LF data packet is outside a range of predetermined frequencies, to conserve power in the disarm device, and transmit an RF disarm data packet when the LF data packet is within the predetermined range of frequencies and comprises a first approved identifier (ID); and means for automatically disarming the security system when the RF disarm data packet comprises a second approval ID.

16. The security system of claim 15, wherein the first approved ID is one of a Door ID associated with the door and a System ID associated with the security system, and wherein the first approved ID is stored in the disarm device.

17. The security system of claim 15, further comprising means for transmitting a door open message when the RF disarm data packet comprises an ID that is different than the second approved ID.

18. The security system of claim 15, wherein the LF transmitter is configured to transmit a plurality of the LF data packets separated by predetermined time periods until the RF disarm data packet is received or a predetermined number of LF data packets are transmitted, whichever comes first.

* * * * *